US009378688B2

(12) United States Patent
Brush

(10) Patent No.: US 9,378,688 B2
(45) Date of Patent: Jun. 28, 2016

(54) SYSTEM AND METHOD FOR CONTROLLING BRIGHTNESS IN AREAS OF A LIQUID CRYSTAL DISPLAY

(71) Applicant: Caterpillar Inc., Peoria, IL (US)

(72) Inventor: Jeffrey Alan Brush, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/551,787

(22) Filed: Nov. 24, 2014

(65) Prior Publication Data

US 2016/0148580 A1 May 26, 2016

(51) Int. Cl.
*G09G 5/10* (2006.01)
*G09G 3/36* (2006.01)

(52) U.S. Cl.
CPC ..... *G09G 3/36* (2013.01); *G09G 2320/0626* (2013.01)

(58) Field of Classification Search
CPC ... G02B 26/001; G09G 3/3466; G09G 5/026; G09G 2320/0242; G09G 2300/0469; G09G 2310/0208; G09G 2340/06; H04N 9/67; H04N 1/6016
USPC ..... 345/690, 589, 8, 418, 619, 2.2; 348/222.1, 239; 382/130, 141
See application file for complete search history.

(56) References Cited

U.S. PATENT DOCUMENTS 7,036,025 B2 4/2006 Hunter
7,221,363 B2 5/2007 Roberts et al.
8,132,117 B2 3/2012 Hedrick
8,368,838 B2 2/2013 Kumasaka et al.
2002/0180727 A1* 12/2002 Guckenberger ..... G06T 11/60 345/418
2007/0146344 A1 6/2007 Martin et al.
2011/0249035 A1 10/2011 Arai
2012/0206475 A1* 8/2012 Bryant ..... G11B 27/034 345/589
2013/0038212 A1 2/2013 Yabuta
2013/0162856 A1* 6/2013 Song ..... G06F 3/04845 348/222.1
2013/0182002 A1* 7/2013 Macciola ..... H04N 1/387 345/589
2013/0335682 A1 12/2013 Gilbert et al.
2014/0111535 A1* 4/2014 Cocco ..... G09G 5/30 345/589
2015/0055851 A1* 2/2015 Nykyforov ..... G06K 9/342 382/141
2015/0062382 A1* 3/2015 Cote ..... G06T 5/50 348/239
2015/0110372 A1* 4/2015 Solanki ..... G06T 7/0014 382/130
2015/0300833 A1* 10/2015 van Os ..... G01C 21/3626 701/400
2015/0309314 A1* 10/2015 Border ..... G02B 27/0172 345/8

* cited by examiner

*Primary Examiner* — Thuy Pardo
(74) *Attorney, Agent, or Firm* — Edward Lin; Caterpillar Inc.

(57) ABSTRACT

A control system, and related method are disclosed for controlling brightness in areas of a LCD. The control system may comprise a LCD including a first display area and a second display area, and a controller in communication with the LCD. The controller may be configured to display an icon at an icon brightness level in the first display area, display a first image in the second display area, and display a mask image over the first image. The first image is visible through the mask image at a first composite brightness level. The first composite brightness level is less than the icon brightness level.

11 Claims, 8 Drawing Sheets

SYSTEM AND METHOD FOR CONTROLLING BRIGHTNESS IN AREAS OF A LIQUID CRYSTAL DISPLAY

TECHNICAL FIELD

The present disclosure generally relates to control systems and, more particularly, for control systems, for controlling brightness in areas of a Liquid Crystal Display (LCD) mounted in operator cabs on machines used in mining, earth moving, construction, and material handling applications, and the like.

BACKGROUND

Machines and vehicles (collectively, "Machines") in industrial applications may have operator display screens that utilize LCD technology. Such operator display screens may display operational and machine parameters, measurements, and the like as well as system health and warning indicators. During nighttime operation of the Machine, it is desirable to dim the display screen except for the system health and warning indicators because it is desirable to have such indicators visually stand out from the rest of the information on the display screen in order to gain the operator's attention. While older light emitting diode technology allowed for separate back lighting control of a region dedicated to provide system health and warning indicators, LCD technology typically does not. Thus, when an LCD screen is dimmed for nighttime operations, the system indicators are dimmed too. As a result there is no localized brightness that can differentiate for the operator the system health and warning indicators from the rest of the display.

US Publication No. 2007/0146344 published Jun. 28, 2007 (the '344 Publication) discloses a display module for dimming an area of interest in a display screen by varying voltage to the area of interest. This type of arrangement is complicated to implement. A better system is needed.

SUMMARY OF THE DISCLOSURE

In accordance with one aspect of the disclosure, a control system is disclosed. The control system may comprise a LCD including a first display area and a second display area, and a controller in communication with the LCD. The controller may be configured to display an icon at an icon brightness level in the first display area, display a first image in the second display area, and display a mask image over the first image. The first image is visible through the mask image at a first composite brightness level. The first composite brightness level is less than the icon brightness level.

In accordance with another aspect of the disclosure, a method of controlling the localized brightness on an LCD is disclosed. The LCD may include a first display area and a second display area. The method may comprise displaying, by a controller, an icon in the first display area at an icon brightness level, displaying, by the controller, a first image in the second display area, and displaying, by the controller, a mask image in the second display area, the mask image positioned to cover the first image. The first image is visible through the mask image at a composite brightness level. The composite brightness level is less than the icon brightness level.

In accordance with a further aspect of the disclosure, a control system is disclosed. The control system may comprise a LCD disposed on a Machine, and a controller in communication with the LCD. The LCD may include a first display area and a second display area. The controller may be configured to display a system health or warning icon at an icon brightness level in the first display area, display a plurality of images in the second display area, and display a mask image over one or more of the images in response to a dimming input received by the controller. Each of the images over which the mask image is displayed is visible through the mask image at a composite brightness level. The composite brightness level less is than the icon brightness level.

DETAILED DESCRIPTION

Figure 1:
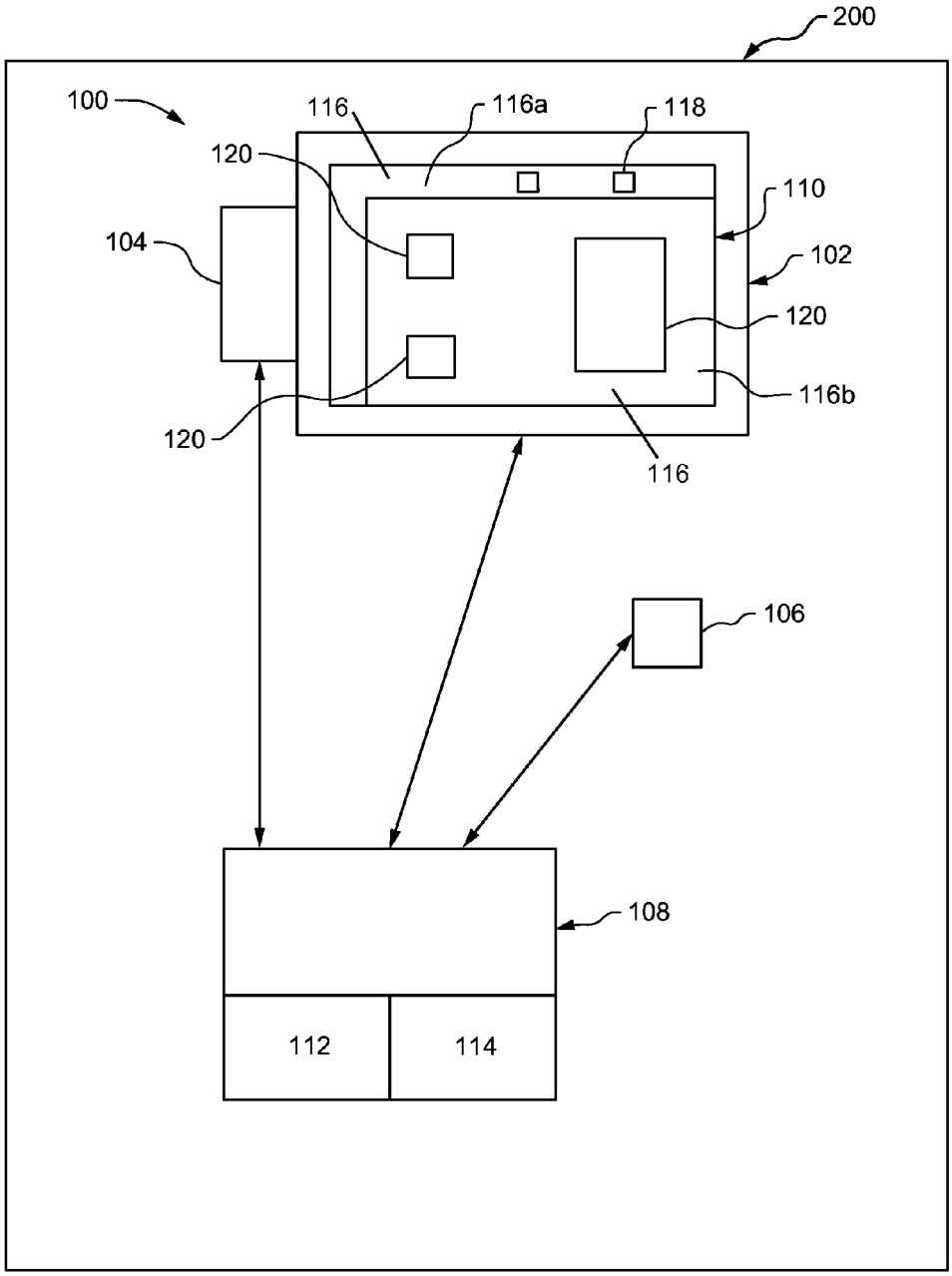
FIG. 1 is a general schematic view of an exemplary embodiment of a control system constructed in accordance with the teachings of this disclosure.

Referring now to the drawings, and with specific reference to FIG. 1, there is shown a control system in accordance with the present disclosure and generally referred to by reference numeral 100. The control system 100 comprises an LCD 102 disposed on a Machine 200 (FIG. 2) and a controller 108 (FIG. 1). The controller 108 may be disposed on the Machine 200 (FIG. 2) or may be remote from the Machine 200. The control system 100 may also include a user interface 104 (FIG. 1). The user interface 104 may be part of the LCD 102 or may be separate from the LCD 102. The control system 100 may also include a light sensor 106 disposed on the Machine 200 (FIG. 2) that measures and transmits to the controller 108 data indicating the level of ambient light available in the operator cab 226 (of the machine 200).

Figure 2:
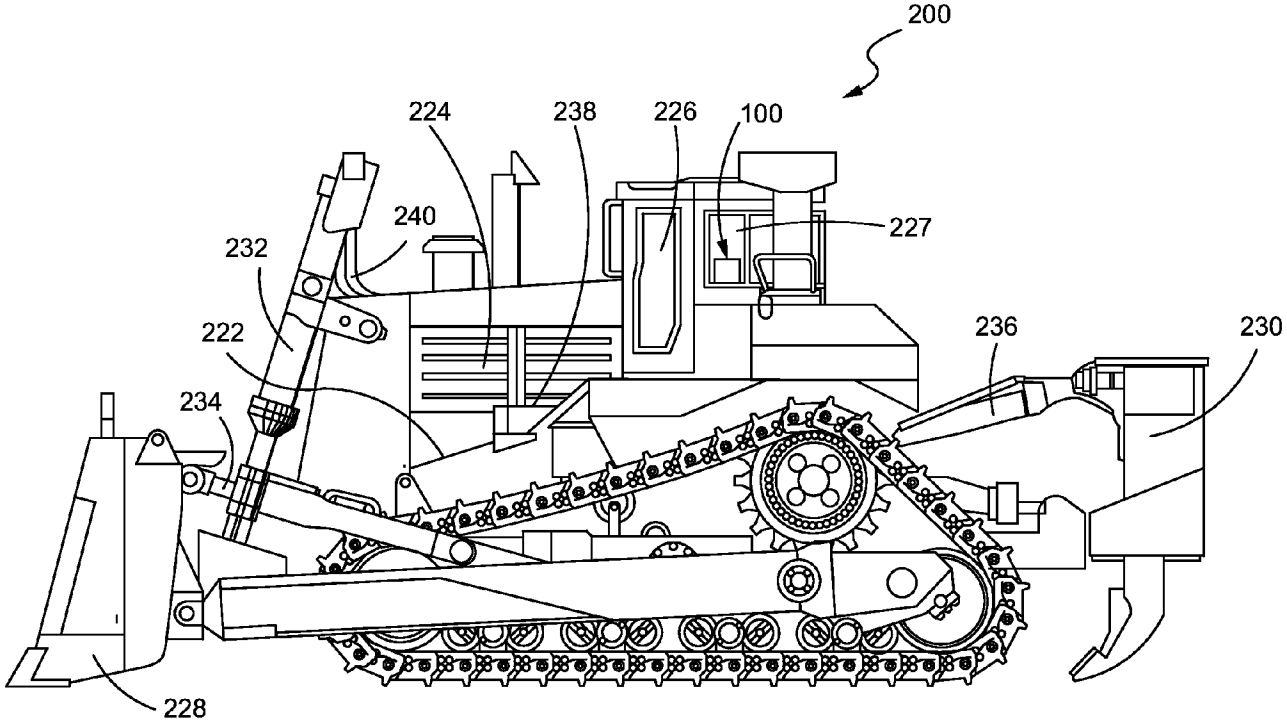
FIG. 2 is a perspective view of an embodiment of an exemplary vehicle in which a control system in accordance with the teachings of this disclosure may be used.

FIG. 2 illustrates one example of a vehicle 200 that incorporates the features of the present disclosure. While the following detailed description and drawings are made with reference to the control system 100 mounted on a track type tractor 200, the teachings of this disclosure may be employed on other mining, earth moving, construction, material handling, or the like vehicles and machines.

In the illustrated embodiment, the track-type tractor 200 may include a chassis 222 supporting an engine 224. An operator cab 226 also may be supported by the chassis 222 behind the engine 224. The operator cab 226 may define an interior space 227. Various tools or implements may be mounted on the tractor 200, such as, but not limited to, a blade 228 and a ripper 230. Hydraulic cylinders may be used to lift or otherwise move the tools and implements. For example, a pair of lift cylinders 232 (only one shown in FIG. 2) and a tilt cylinder 234 may be provided to manipulate the blade 228. Similarly, a ripper cylinder 236 may be provided to manipulate the ripper 230. A hydraulic pump 238 may be operatively coupled to the engine 224 to provide pressurized hydraulic fluid via hoses 240 to hydraulic cylinders 232, 234, 236.

Turning back to FIG. 1, the LCD 102 is in operably communication with the controller 108. The LCD 102 may be any appropriate LCD as is known in the art. For example, the LCD 102 may be a touch screen user interface 104 configured to receive user input and to display output. The LCD 102 may be disposed in the interior space 227 defined by the operator cab 226 on the Machine 200.

In an embodiment, the LCD 102 includes a screen 110. The screen 110 includes a plurality of display areas 116. For example, in one embodiment, the screen 110 of the LCD 102 includes a first display area 116*a* and a second display area 116*b*. In other embodiments, there may be more display areas 116.

One or more icons 118 may be displayed in the first display area 116*a*. In one embodiment, such icons 118 may be system indicators or warning indicators. For example, such indicators may provide notification to the operator that: the parking brake is applied, implement lockout is active, there is an emissions system malfunction, the fuel level is low, the operator's seat belt is unlatched, there is a steering, charging system or engine failure, and the like. When displayed in the first display area 116*a*, or any other display area 116, the icons 118 are displayed on the LCD 102 at an icon brightness level.

One or more images 120 may be displayed in the second display area 116*b*. Since LCD's 102 generally are not selectively dimmed in localized areas like displays that use light emitting diodes, these images 120 will be displayed on the LCD 102 at an output brightness level that is the same as icon brightness level. In one embodiment, such images 120 may include, but are not limited to, fuel gauges, temperature, speed, location mapping, compaction degree, lighting or other features, and images indicating that the right or left turn signal is on, blade float is active, traction control is active, the differential lock is applied, the machine 200 is operating in economy mode or auto shift, the winch lock is active, and the like.

Figure 3:
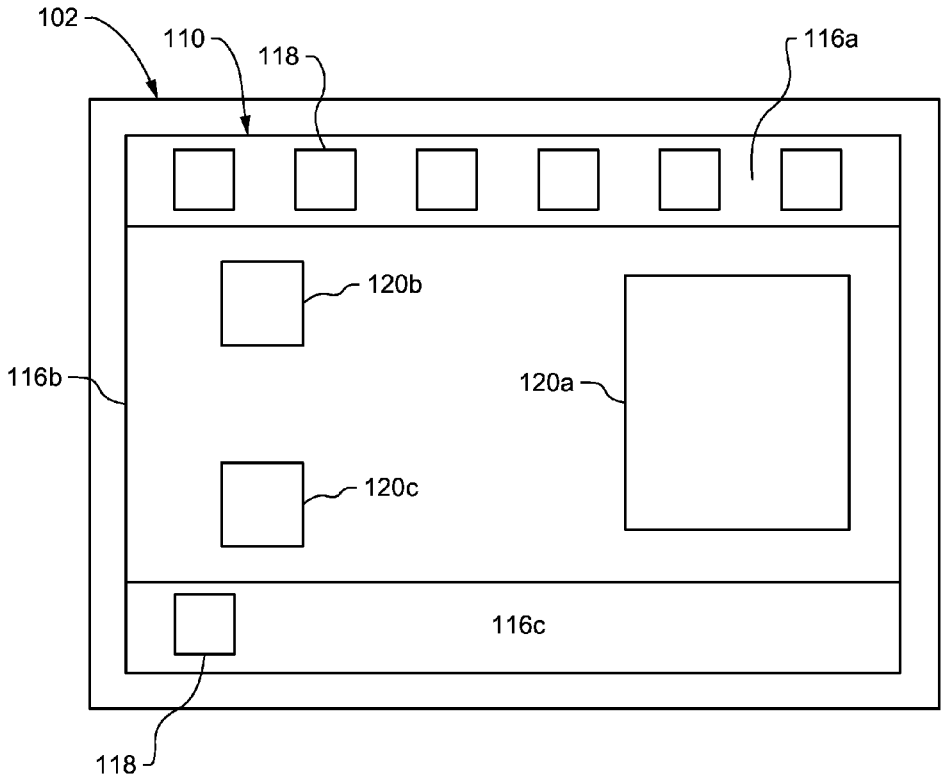
FIG. 3 illustrates an exemplary schematic of a LCD without mask image(s)

FIG. 3 illustrates a schematic of the exemplary LCD 102. In this embodiment, the LCD 102 comprises the screen 110 that includes a first, second and third display areas 116(*a-c*). Icons 118 are displayed in the first display area 116*a*. Images 120(*a-c*) are displayed in the second display area 116*b*. In some embodiments, one or more icon(s) 118 may be displayed in the third display area 116*c* of the LCD 102. The third display area 116*c* may be different than the first and second display areas 116(*a-b*). The icon(s) 118 displayed in the third display area 116*c* may be displayed at the icon brightness level.

In some embodiments, the icons 118 do not overlap. The icons 118 are displayed at the icon level brightness level and the images 120(*a-c*) are displayed on the LCD 102 at the icon brightness level. In some embodiments, icon brightness level may be the maximum brightness level allowed by the LCD 102. In other embodiments, the icon brightness level may be a lower level of brightness, such as for example, when a lower power is supplied to the LCD 102 as a whole. Regardless, both the icons 118 and the images 120(*a-c*) will be displayed at the same level of brightness (in the absence of mask image(s) 122 being utilized.)

Figure 4:
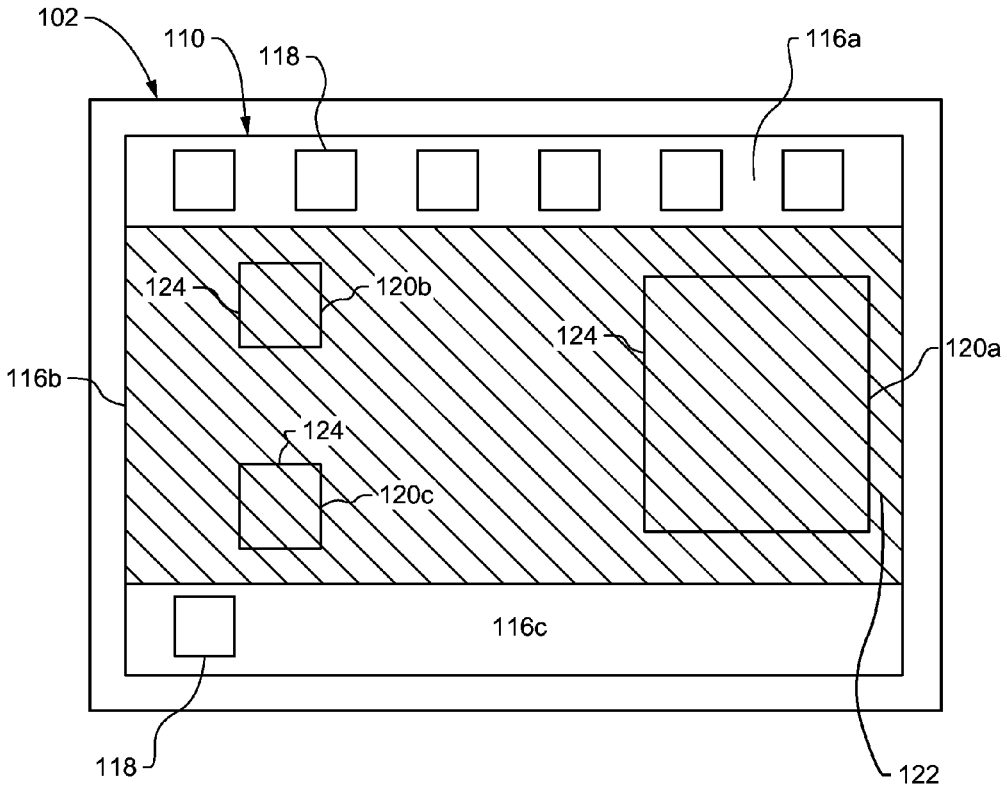
FIG. 4 illustrates an exemplary schematic of a LCD with a mask image.

Referring now to FIG. 4, to reduce the visible brightness level of the LCD 102 as viewed by an observer, one or more mask images 122 may be selectively displayed (on the LCD 102) over each of the images 120(*a-c*). In such a scenario, each underlying image 120(*a-c*) is visible through the mask image(s) 122 at a composite brightness level. This composite brightness level (as viewed by an observer of the composite (image) 124, the composite 124 comprised of the underlying image 120 and the (overlayed) mask image(s) 122) is less than the icon brightness level and provides the visual effect of localized dimming of the underlying image 120 on the LCD 102. Such localized dimming is accomplished without varying the voltage level applied to backlighting for the transmissive light valve elements of the LCD 102. Such localized dimming (via application of mask images 122) is also accomplished without dimming (or controlling) each individual transmissive light valve element of the LCD 102; while such dimming (or controlling) of each individual transmissive light valve element of the LCD 102 may result in reduced power consumption, it does not result in the application of a separate transparent mask image 122 (overlayed image) through which the underlying image 120 is visible.

As mentioned above, FIG. 4 illustrates one embodiment where the masking of images 120 provides localized dimming of the images. In particular, FIG. 4 illustrates a schematic of the same exemplary LCD 102 as seen in FIG. 3, except that now the mask image 122 is also utilized. In FIG. 4, the mask image 122 is displayed over the images 120(*a-c*) in the second display area 116*b*. The mask image 122 is dark-toned in color and appears transparent in so far as each underlying image 120(*a-c*) is visible on the LCD 102 through the mask image 122. Dark toned may be for example, grey-toned, brown-toned, or the like, to give the effect of a darker overlying image. The mask image 122 is displayed on top of the one or more images 120(*a-c*) thereby covering the images 120 (*a-c*) on the second display area 116*b*. The composite 124 of each underlying image 120 (*a-c*) and the mask image 122 results in each underlying image 120(*a-c*) being visible (through the mask image 122) on the LCD 102 at a composite brightness level that is less than the icon brightness level. For example, in one embodiment, the first icon brightness level is about twice the value of the composite brightness level. In other embodiments, the value of the composite brightness level may be about eighty percent of the first icon brightness level. Other percentages are contemplated, for example, the composite brightness level may be in the range of about 95% to about 5% of the icon brightness level.

As shown in FIG. 4, the first image 120*a*, the second image 120*b*, and the third image 120*c* generally do not overlap and are displayed in the second display area 116*b*. In other embodiments, they could overlap. In the embodiment illustrated in FIG. 4, the single mask image 122 covers the first image 120*a*, the second image 120*b* and the third image 120*c*. In FIG. 4 the mask image 122 is shown as covering the entire second display area 116*b*. In other embodiments, such as the one illustrated in FIG. 5, a first mask image 122*a* may cover the first image 120*a*, a second mask image 122*b* may cover the second image 120*b*, and a third mask image 122*c* may cover the third image 120*c*.

Figure 8:
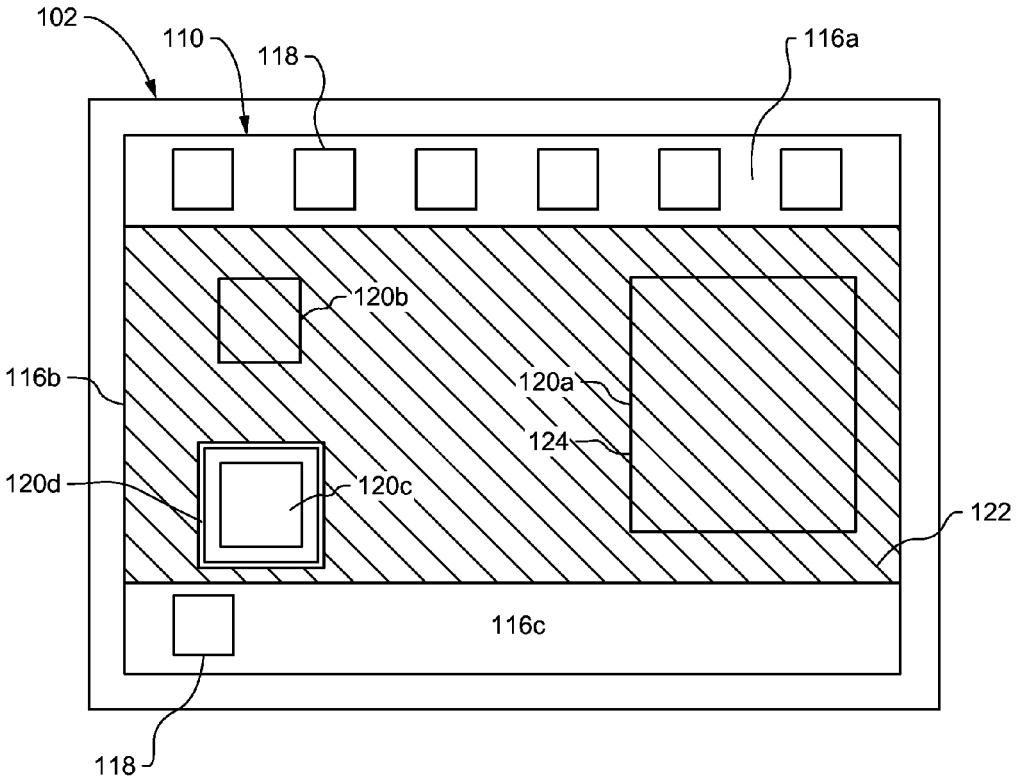
FIG. 8 illustrates another exemplary schematic of a LCD with a mask image.

In other embodiments, the mask image 122 may cover some but not all of the images 120 in the second display area 116*b*. Alternatively, in some embodiments the mask image 122 may cover only a portion of the second display area 116*b*, thus leaving another portion of the second display area 116*b* (and any images 120 displayed in that other portion) free of the mask image 122. For example, as shown in FIG. 8, the mask image 122 covers the first and second images 120(*a-b*) and a portion of the second display area 116*b*, but does not cover the third image 120*c* and does not cover a frame image 120*d* surrounding the third image 120*c*.

Regardless, the images 120, when covered with a mask image 122, are each displayed at a composite brightness level that is less than the icon brightness level. If the image 120 is not covered with the mask image 122, it will be displayed at an output brightness level that is the same as or substantially the same as the icon brightness level.

Figure 5:
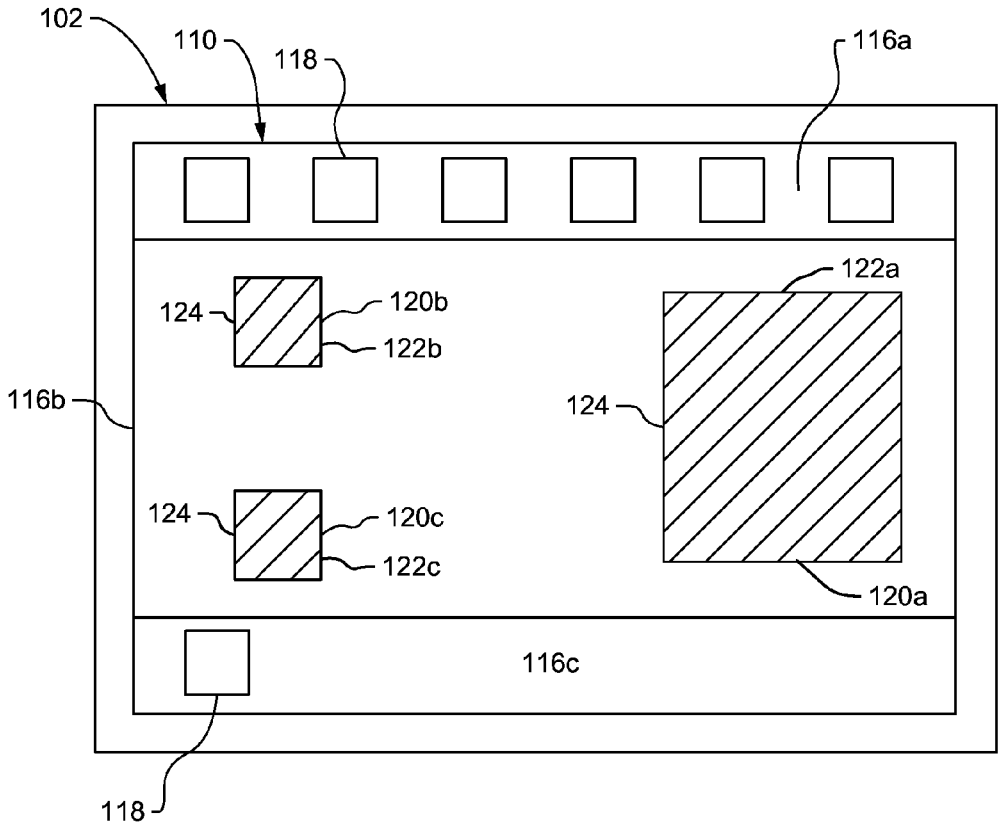
FIG. 5 illustrates an another exemplary schematic of a LCD with mask images.

For clarity, the following will be described in connection with the image 120 and mask image 122 arrangement shown in FIG. 4 but it is understood that the following also applies to alternative embodiments such as, for example, those described in FIGS. 5 and 8. In one embodiment, the degree of visual dimming of the image(s) 120 and/or areas of the LCD 102 may be accomplished by use of different mask images 122 that have different degrees of transparency associated with them. For example, in one scenario, a user may desire to dim the image(s) 120 in the second display area 116*b* of the LCD 102. To do so the mask image 122 may be displayed over the image(s) 120. In one embodiment, the mask image 122 may be black colored with a high degree of transparency such that the underlying image(s) 120 are visible through the displayed mask image 122 but appear to an observer to be slightly dimmed (the composite brightness level less is less than the icon brightness level). If further dimming of the image(s) 120 is desired, the controller 108 may remove the current mask image 122 and replace it with another mask image 122 that is less transparent. Thus, the composite 124 of the underlying image(s) 120 and the less transparent (replacement) mask image 122 appears to the observer to be more dimmed than the previous composite 124 (in other words, the new composite brightness level of the underlying image(s) 120 and the replacement mask image 122 is less than the previous composite brightness level of the image(s) 120 and the prior mask image 122). If less dimming is desired, the controller 108 may remove the mask image 122 and replace it with another mask image 122 that has greater transparency.

If more or less dimming is desired for some of the images 120 in the second display area 116*b*, the controller 108 may replace a current mask image 122 with another mask image 122 of a different shape or area of coverage. For example, the controller 108 may typically dim (via display of an overlying mask image 122) an image 120, such as an engine temperature image, in the second display area 116*b*. If engine temperature (or other operational parameter related to the image 120) is close to a range of concern, the controller 108 may replace the currently displayed mask image 122 (that results in the dimming of the engine temperature image) with a mask image 122 that may cover some or all of the other images 120 in the second display area 116*b* but does not cover the engine temperature image or provides for a greater transparency over the engine temperature image such that there is less dimming of the engine temperature image 120 than other images 120 in the second display area 116*b*.

Figure 6:
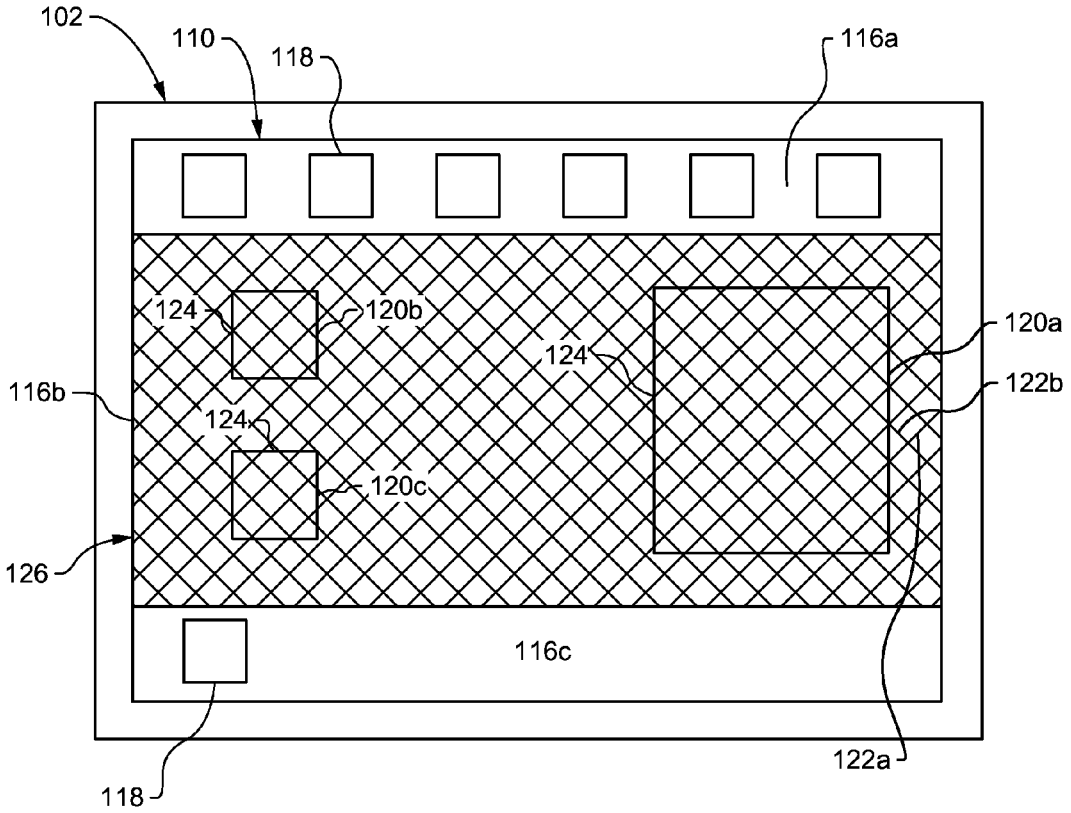
FIG. 6 illustrates an exemplary schematic of a LCD with a plurality of mask images.

For clarity, the following will be described in connection with the image 120 and mask image 122 arrangement shown in FIGS. 4 and 6 but it is understood that the following also applies to alternative embodiments such as, for example, those described in FIGS. 5 and 8 in which the displayed mask images 122 do not cover the entire second display area 116*b*. In some embodiments, the mask image 122 displayed in the second display area 116*b* may be a plurality of overlapping individual mask images 122 disposed (stacked) on top of each other with the underlying image 120 at the bottom of (or underneath) the "stack" 126 of mask images 122. One embodiment of such a scenario is shown in FIG. 6 where two mask images 122(*a-b*) have been applied in the second display area 116*b*. Each of such plurality of mask images 122 (*a-b*) is positioned to cover the underlying image, and each is dark-toned in color yet transparent in so far as the underlying image 120 may be seen through the plurality of mask images 122(*a-b*) in the stack 126. In some embodiments, each mask image 122 in the stack 126 may have the same degree of transparency. In other embodiments, the degree of transparency between the mask images 122 in the stack 126 may be different. The stack 126 may include two or more mask images 122. The composite brightness level of the underlying image 120 diminishes with each additional mask image 122 (*a-b*) applied over the underlying image 120. In one embodiment, application of each additional (successive) mask image 122 (*a-b*) in the plurality of mask images 122 of the stack 126 reduces the composite brightness level of the underlying image on the LCD 102 in a stepped manner. As the number of mask images 122 in the stack 126 increases, the composite brightness level decreases and the change in composite brightness level between application of each mask image 122 in the stack 126 may become smaller. In some embodiments, some of the plurality of mask images 122 may be darker toned or less transparent than others, resulting in a more pronounced change in the composite brightness level when such darker mask images 122 are applied on top of the image 120.

The controller 108 may include a processor 112 and a memory component 114. The controller 108 may be in operable communication with LCD 102, the user interface 104 and the light sensor 106. The processor 112 may be a microprocessor or other processor as known in the art.

The processor 112 may be configured to execute instructions and generate control signals for causing the display of one or more icons 118 at an icon brightness level in a first display area 116*a* of the LCD 102, causing the display of an image 120 in a second display area 116*b* of the LCD 102 and reducing the visible brightness of the displayed image 120 by causing one or more mask images 122 to be displayed over the image 120. Such instructions may be read into or incorporated into a computer readable medium, such as the memory component 114 or provided external to the processor 112. In alternative embodiments, hard wired circuitry may be used in place of, or in combination with, software instructions to implement a control method.

The term "computer readable medium" as used herein refers to any non-transitory medium or combination of media that participates in providing instructions to the processor 112 for execution. Such a medium may comprise all computer readable media except for a transitory, propagating signal. Common forms of computer-readable media include, for example, a floppy disk, a flexible disk, hard disk, magnetic tape, or any other magnetic medium, a CD-ROM, any other optical medium, or any other medium from which a computer processor 112 can read.

The controller 108 is not limited to one processor 112 and memory component 114. The controller 108 may be several processors 112 and memory components 114.

In one embodiment the controller 108 may send and receive signals from the LCD 102. Such signals may be a result of user input into the user interface 104 or ambient light level sensed in the operator cab 226 (or elsewhere) by a light sensor 106. The controller 108 may also be configured to retrieve information and data from the memory 114 and to store information and data in memory 114.

In some embodiments, the operator may control the dimming of the images 120. For example, the operator may be able to selectively decrease the output brightness level of images 120 (via application of mask images 122), selectively increase or decrease the composite brightness level of composite (images) 124/underlying image 120 (by adding or removing mask images 122), or remove the mask image 122 to display images 120 at the icon brightness level via input into the user interface 104 ("operator input.") In such embodiments, the received operator input determines transparency of mask image 122 or the number of overlapping mask images 122 to be displayed on top of the image 120. In other embodiments, the controller 108 may automatically dim the images 120 (via application of one or more mask images 122) on the LCD 102 to a default composite brightness level based on the level of ambient light measured in the operator cab 226 by the light sensor 106 ("sensor input.") Such operator input or sensor input that results in dimming of image(s) 120 on the LCD 102 may be referred to as "dimming input."

INDUSTRIAL APPLICABILITY

Figure 7:
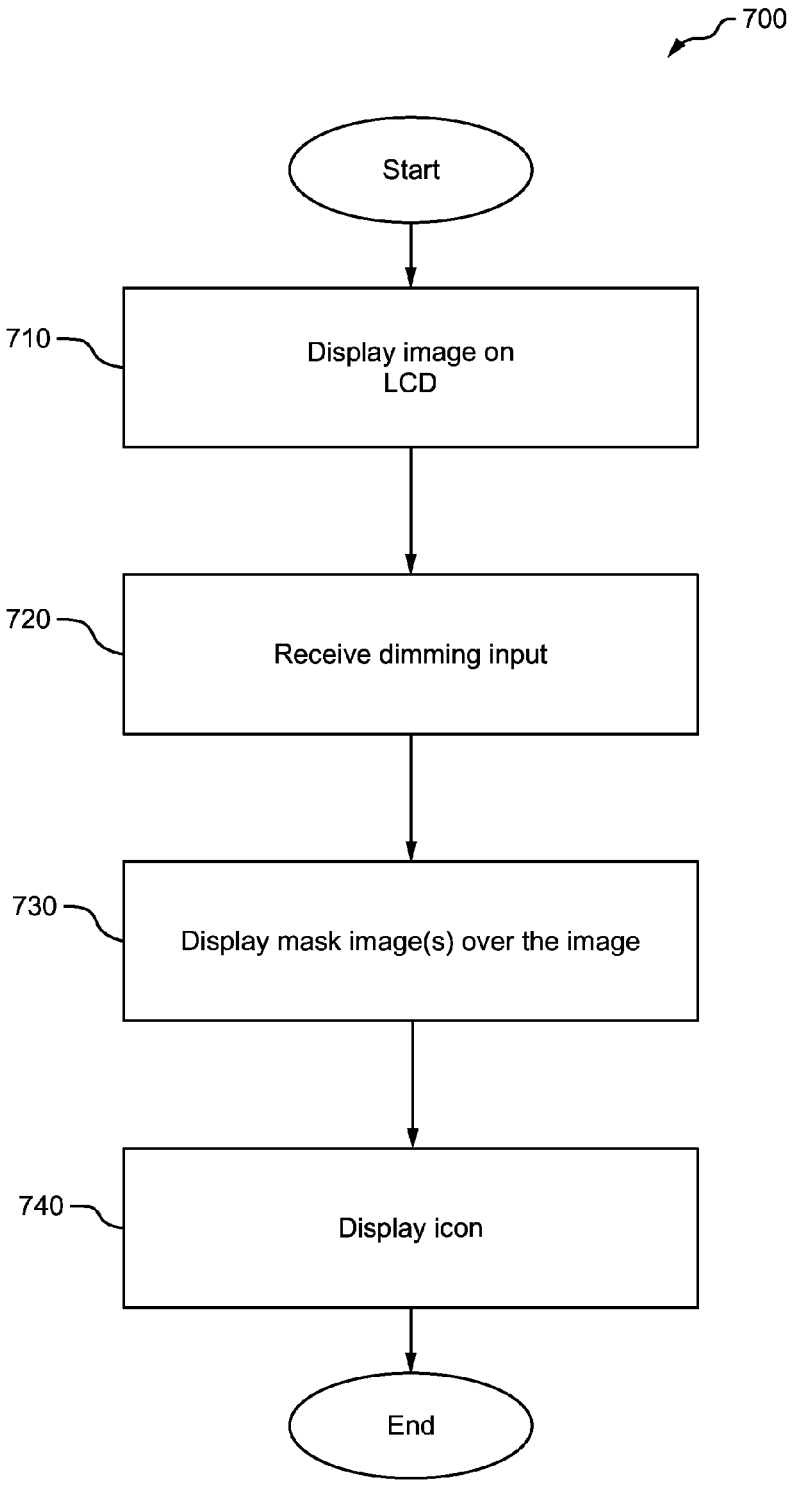
FIG. 7 illustrates an exemplary process in accordance with the teachings of this disclosure.

FIG. 7 illustrates an exemplary process 700 showing sample process blocks which may be followed in relation to controlling the brightness of areas on the LCD 102. The process 700 may be practiced with more or less than the blocks shown and is not limited to the order shown.

In block 710, the controller 108 causes the display of one or more images 120 in, for example, the second display area 116*b* of the LCD 102.

In block 720, the controller 108 receives dimming input identifying an appropriate level of brightness for the one or more images 120. The dimming input may be input received by a user interface 104 and transmitted to the controller 108 by the user interface 104. Alternatively, the dimming input may be generated by the controller 108 after receipt of data from a light sensor 106 in which the data measures the amount of the ambient light in the operator cab 226 of the machine 200 where the LCD 102 is located.

In block 730, in response to the dimming input, the controller 108 causes a mask image 122 to be displayed on the LCD 102 over the one or more images 120. In some embodiments, the mask image 122 may be a plurality of mask images 122. The transparency of the mask image 122 to be displayed, or the number of mask images 122 displayed in a stack 126 of mask images 122 corresponds to the amount of dimming requested by the user, or determined to be appropriate by the controller 108 based on the data transmitted by the light sensor 106. The underlying image 120 is visible through the one or more overlying mask images 122 at a composite brightness level.

In scenarios where only one mask image 122 is displayed over the underlying image 120, different degrees of dimming may be visually obtained for an underlying image 120 on an LCD 102 by the use of different mask images 122 over the underlying image 120, each mask image 122 having a different degree of transparency.

In scenarios where a plurality of mask images 122 are displayed in a stack 126 over the underlying image 120, the composite brightness level (visible to the observer of the LCD 102) of the composite 124 comprised of the underlying image 120 and the displayed mask images 122 decreases with the display of each additional (successive) mask image 122 in the stack 126 of overlapping/overlaying mask images 122. In other words, the application/use of each additional mask image 122 provides the visual effect of dimming further the underlying image(s) 120.

In block 740, the controller 108 causes one or more icons 118 to be displayed on the LCD 102 in the first display area 116*a*. In one embodiment, the icon 118 may be an indicator of system health or a warning indicator, or other indicator. The icon 118 is displayed at the icon brightness level which has a greater brightness value than the composite brightness level.

If the controller 108 receives dimming input that indicates that a lesser level of dimming is desirable for the image(s) 120, the controller 108 may remove the current mask image 122 and replace it with another mask image 122 that has a greater degree of transparency. Alternatively, if the controller 108 receives dimming input that indicates that a lesser level of dimming is desirable for the image(s) 120, the controller 108 may remove some or all of the mask images 122 in a stack 126 (if a stack 126 has been used). If the only mask image 122 is removed or if all of the mask images 122 in a stack 126 are removed, the image(s) 120 will be displayed at the icon brightness level. If some of the mask images 122 in a stack 126 are removed, the images 120 will be displayed at a composite brightness level that may produce a brighter output (less dim) than before but still less bright than the icon brightness level.

In some embodiments, the LCD 102 is not limited to two display areas 116. The LCD 102 may have a plurality of display areas 116 in which icons 118 are displayed and a plurality of other display areas 116 in which images 120 are displayed. If dimming input is received, each of the display areas 116 containing images 120 will have mask image(s) 122 applied to the images 120 to produce a dimming effect. Each display area 116 in which icons 118 are displayed or would be displayed will not have mask images 122 applied.

Also disclosed is a method of controlling the localized brightness on a LCD 102 that includes a first display area 116*a* and a second display area 116*b*. The method may comprise displaying by a controller (108), an icon 118 in the first display area 116*a* at an icon brightness level, displaying by the controller (108), a first image 120*a* in the second display area 116*b*, displaying by the controller (108), a mask image 122 in the second display area 116*b*, the mask image 122 positioned to cover the first image 120*a*, wherein the first image 120*a* is visible through the mask image 122 at a composite brightness level, the composite brightness level less than the icon brightness level.

The features disclosed herein may be particularly beneficial for use with LCDs used in the operator cabs of machines that may operate in low light conditions.

What is claimed is:

1. A control system comprising:

a LCD including a first display area and a second display area; and a controller in communication with the LCD, the controller configured to:

display an icon at an icon brightness level in the first display area, display a first image in the second display area, display a mask image over the first image, wherein the first image is visible through the mask image at a first composite brightness level, the first composite brightness level being less than the icon brightness level, display a plurality of additional overlapping mask images in the second display area, each of the mask images positioned to cover the first image and the first mask image, wherein the first image is visible through the plurality of mask images at a second composite brightness level, the second composite brightness level less than the first composite brightness level, and receive a dimming input from a user interface, and determine the number of overlapping mask images to be applied to the first image based on the dimming input.

2. The control system of claim 1, in which the controller is further configured to remove the mask image from the first image, wherein the first image is visible at about the icon brightness level.

3. The control system of claim 1, wherein the controller is further configured to cause the LCD to display a second image in the second display area, wherein the mask image covers the second image and the second image is visible through the mask image at the first composite brightness level.

4. The control system of claim 1, wherein the first icon brightness level is twice a value of the second composite brightness level.

5. The control system of claim 1, wherein the icon is a system health indicator.

6. A method of controlling the localized brightness on a LCD that includes a first display area and a second display area, the method comprising:

displaying, by a controller, an icon in the first display area at an icon brightness level;

displaying, by the controller, a first image in the second display area; and displaying, by the controller, a mask image in the second display area, the mask image positioned to cover the first image, wherein the first image is visible through the mask image at a composite brightness level, the composite brightness level being less than the icon brightness level, and wherein the mask image is comprised of a plurality of overlapping mask images, wherein the composite brightness level is diminishable with each successive mask image of the plurality of overlapping mask images;

receiving, by the controller, a dimming input; and adjusting the number of masks applied over the first image based on the dimming input.

7. The method of claim 6, further comprising removing the mask image from the first image, wherein when the mask image is removed from the first image the first image is displayed at about the icon brightness level.

8. The method of claim 6, further including receiving a dimming input from a user interface.

9. The method of claim 6, further comprising:

removing the mask image from the first image; and replacing the removed mask image with a different mask image that is less transparent than the removed mask image, wherein the first image is visible through the different mask image at a second composite brightness level, the second composite brightness level less than the prior composite brightness level.

10. The method of claim 6, further comprising displaying another icon in a third display area of the LCD, the third display area different than the first and second display areas, the other icon displayed at the icon brightness level.

11. A control system comprising:

a LCD disposed on a Machine, the LCD including a first display area and a second display area; and a controller in communication with the LCD, the controller configured to:

display a system health or warning icon at an icon brightness level in the first display area, display a plurality of images in the second display area, and display a mask image over one or more of the images in response to a dimming input received by the controller, wherein each of the images over which the mask image is displayed are visible through the mask image at a composite brightness level, the composite brightness level less than the icon brightness level, wherein the mask image comprises a plurality of overlapping mask images, wherein the composite brightness level is diminishable with each successive mask image in the plurality of overlapping mask images, wherein further each successive mask image may be selectively displayed in response to the dimming input or removed in response to the dimming input, wherein the dimming input is provided by a light sensor.

* * * * *